US006433674B2

(12) United States Patent
Kuwabara et al.

(10) Patent No.: US 6,433,674 B2
(45) Date of Patent: Aug. 13, 2002

(54) ELECTROMAGNETIC SOUND GENERATOR

(75) Inventors: Atsushi Kuwabara; Masato Asahina, both of Yamanashi-ken (JP)

(73) Assignee: Citizen Electronics Co., Ltd., Fujiyoshida (JP)

( * ) Notice: Subject to any disclaimer, the term of this patent is extended or adjusted under 35 U.S.C. 154(b) by 0 days.

(21) Appl. No.: 09/814,740

(22) Filed: Mar. 23, 2001

(30) Foreign Application Priority Data

Apr. 10, 2000 (JP) ..... 2000-108686

(51) Int. Cl.[7] ..... G08B 3/00

(52) U.S. Cl. ..... 340/391.1; 340/388.1; 340/388.5

(58) Field of Search ..... 340/388.1, 388.3, 340/388.5, 390.1, 391.1, 392.1, 392.2, 398.2; 381/151, 193, 200; 310/71, 81, DIG. 6; 116/142 R

(56) References Cited

U.S. PATENT DOCUMENTS 4,763,109 A * 8/1988 Smith ..... 340/391.1
5,524,061 A * 6/1996 Mooney et al. ..... 381/151
5,841,343 A * 11/1998 Hapke et al. ..... 340/390.1
6,291,915 B1 * 9/2001 Yamaguchi ..... 310/71

* cited by examiner

*Primary Examiner*—Van Trieu
(74) *Attorney, Agent, or Firm*—Dennison, Schultz & Dougherty

(57) ABSTRACT

An electromagnetic sound generator has a vibrating plate mounted in a case. An armature is secured on the vibrating plate at a central portion thereof. The armature has a concave spherical shape.

3 Claims, 4 Drawing Sheets

ELECTROMAGNETIC SOUND GENERATOR

BACKGROUND OF THE INVENTION

The present invention relates to an electromagnetic sound generator, and more particularly to a vibrating plate of the sound generator.

In recent years, surface mount technology has been developed where electronic parts are directly mounted on a printed circuit board. The electromagnetic sound generator used in the portable telephone and beeper is also mounted on the circuit board.

FIG. 5 is a plan view of a conventional electromagnetic sound generator in which upper parts thereof are removed along a line V—V of FIG. 6. FIG. 6 is a sectional view taken along a line VI—VI of FIG. 5, and FIGS. 7*a* and 7*b* are sectional views of a vibrating plate of the sound generator.

Referring to FIG. 5, a case 50 of the electromagnetic sound generator comprises a lower case 51 and an upper case 52. A pair of cylindrical holes 51*b* are formed in the lower case 51, and an annular projection 51*a* is formed on the lower case 51.

A yoke 53 made of magnetic material is mounted on the bottom of the lower case 51. A core 53*a* is formed on the surface of the yoke 53 and a notch 53*b* is formed in the yoke 53. An annular magnet 55 and a coil 54 are mounted on the yoke 53. A circular vibrating plate 56 is secured on the annular projection 51*a*. An armature 57 comprising a circular magnetic plate is secured to the vibrating plate 56 at the central portion thereof so as to oppose to the core 53*a*. Thus, a magnetic circuit for a buzzer is formed by the yoke 53, core 53*a*, magnet 55 and vibrating plate 56.

A pair of lead plates 58, each of which is made of an elongated metal plate, are embedded in the lower case 51. Each of the lead plates 58 is extended between the upper end of the hole 51*b* and an end 58*a* in the notch 53*b* of the yoke 53. A coil spring 59 is inserted in each hole 51*b*. An upper end of the coil spring 59 is inserted in a hole 58*c* formed in an end portion 58*b* of the lead plate 58 and electrically connected to the lead plate 58 by solder. The lower end of the spring 59 is projected from the lower case 51. The upper case 52 is adhered to the lower case 51 so that a sound emanating hole 50*a* is formed between the upper case 52 and the lower case 51.

When a signal current flows in the coil 54 passing through springs 59 and lead plates 58, the coil 54 is excited to attract the armature 57. Thus, the armature 57 is vibrated to produce sounds which emanate from the sound emanating hole 50*a*.

As shown in FIG. 7*a*, the armature 57 is a flat magnetic plate formed by stamping out a flat material plate. When the armature 57 is attracted to the core 53*a*, the vibrating plate 56 is bent as shown in FIG. 7*b*. As a result, there occurs stress concentration along the peripheral edge of the armature 57. The concentrated stress restrains the vibrating plate 56 from vibrating, which causes the vibration to be unstable.

SUMMARY OF THE INVENTION

An object of the present invention is to provide an electromagnetic sound generator in which a vibrating plate may be stably vibrated without stress concentration, thereby providing a stable sound emanating characteristic.

According to the present invention, there is provided an electromagnetic sound generator comprising a case, an electromagnet having a vibrating plate mounted in the case, an armature secured on the vibrating plate, wherein the armature having a concave spherical shape, and secured to the vibrating plate at a central portion thereof.

The armature has a uniform thickness.

The armature has a radius curvature so that a peripheral edge of the armature does not contact with the vibrating plate when the vibrating plate is vibrated at a maximum amplitude.

These and other objects and features of the present invention will become more apparent from the following detailed description with reference to the accompanying drawings.

DETAILED DESCRIPTION OF THE PREFERRED EMBODIMENT

Figure 1:
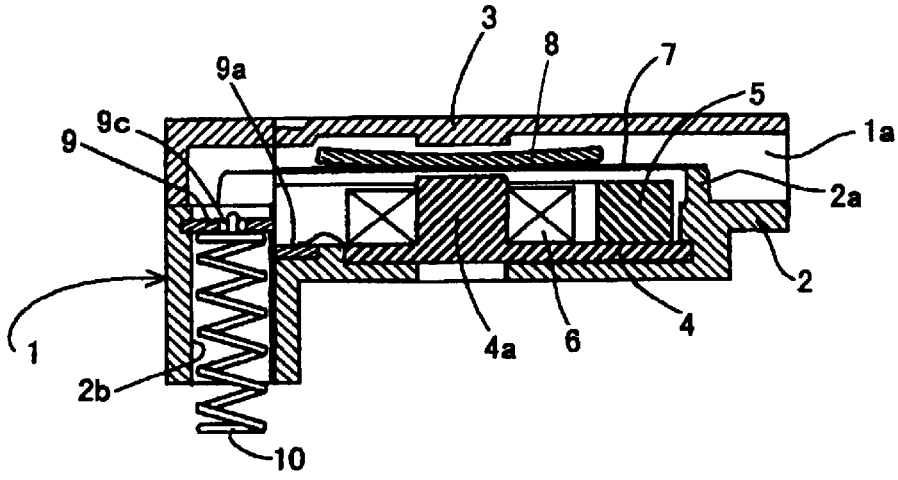
FIG. 1 is a sectional view of an electromagnetic sound generator according to the present invention.
Figure 2:
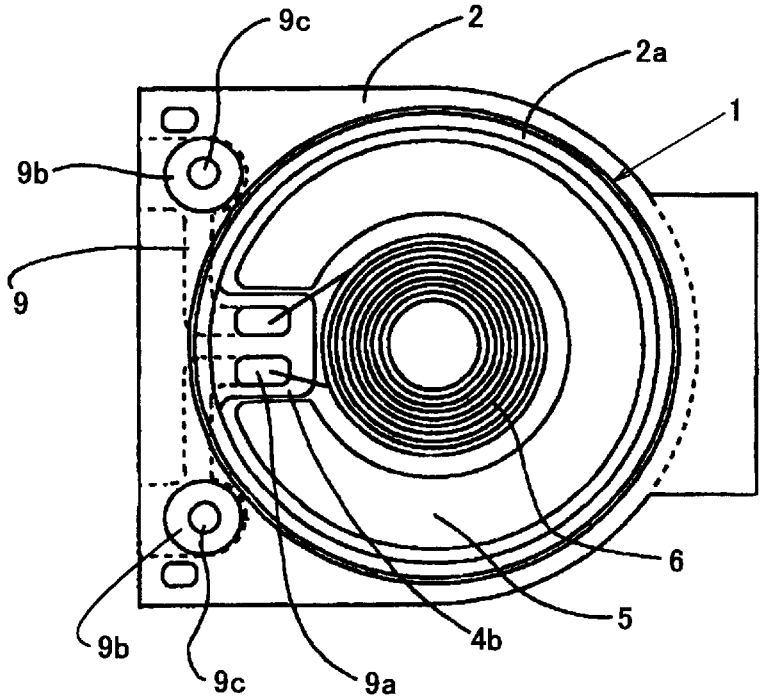
FIG. 2 is a plan view of the sound generator.

Referring to FIGS. 1 and 2, a case 1 of the electromagnetic sound generator of the present invention has a case comprising lower case 2 and an upper case 3. A pair of cylindrical holes 2*b* are formed in the lower case 2, and an annular projection 2*a* is formed on the lower case 2.

A yoke 4 made of magnetic material is mounted on the bottom of the lower case 2. A core 4*a* is formed on the surface of the yoke 4 and a notch 4*b* is formed in the yoke 4. A circular magnet 5 and a coil 6 are mounted on the yoke 4. A circular vibrating plate 7 is secured on the annular projection 2*a*. An armature 8 comprising a circular magnetic plate is secured to the vibrating plate 7 at the central portion thereof so as to oppose to the core 4*a*. Thus, an electromagnet having a magnetic circuit comprising the yoke 4, core 4*a*, magnet 5, armature 8 and vibrating plate 7 is formed.

A pair of lead plates 9, each of which is made of an elongated metal plate, are embedded in the lower case 2. Each of the lead plates 9 is extended between the upper end of the hole 2*b* and an end 9*a* in the notch 4*b* of the yoke 4. A coil spring 10 is inserted in each hole 2*b*. An upper end of the coil spring 10 is inserted in a hole 9*c* formed in an end portion 9*b* of the lead plate 9 and electrically connected to the lead plate 9 by solder. The lower end of the spring 10 is projected from the lower case 2. The upper case 3 is adhered to the lower case 2 so that a sound emanating hole 1*a* is formed between the upper case 3 and the lower case 2.

The armature 8 is formed into a concave spherical shape in accordance with the present invention. The armature 8 is fixed to the vibrating plate 7 at a central portion by pinpoint welding.

Figure 3A:
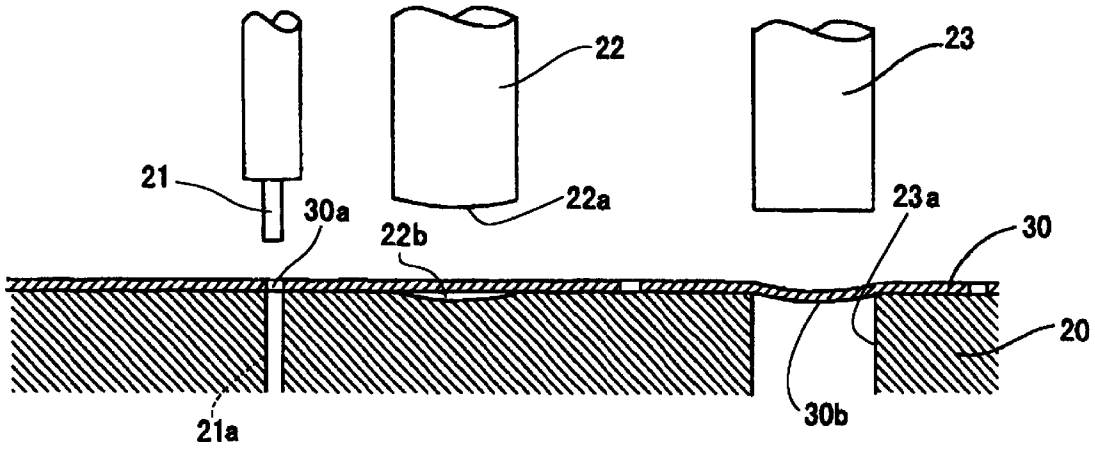
FIGS. 3*a*, 3*b* and 3*c* show steps for press working for manufacturing an armature of the present invention.
Figure 3B:
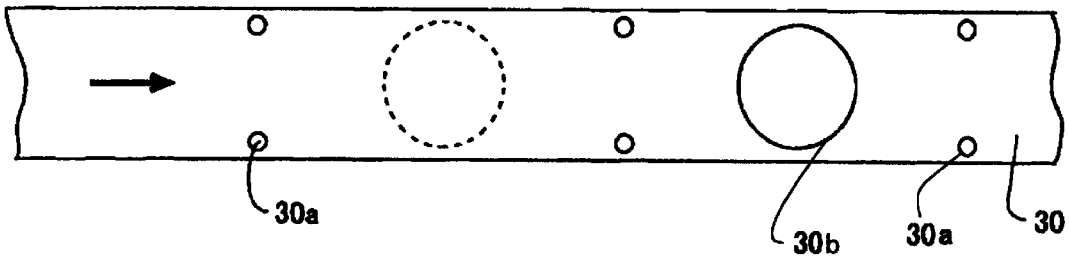
Figure 3C:
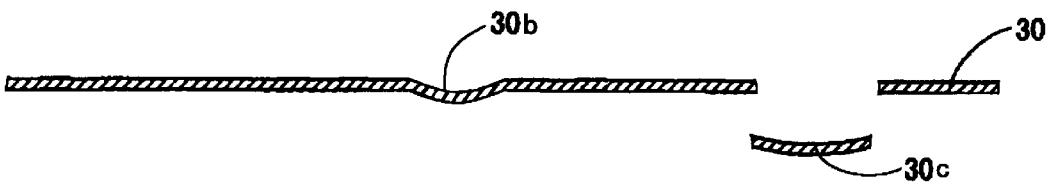

Referring to FIGS. 3*a* and 3*b*, the press machine comprises a die 20, a pair of pilot punches 21, a striking punch 22 having a spherical working surface 22*a*, and a blank-through punch 23. These punches 21, 22 and 23 are arranged in the moving direction of a strip 30. The die 20 has a pair of pilot positioning holes 21*a*, a concave spherical recess 22*b*, and a blanking hole 23*a*.

The strip 30 is intermittently fed to the right in FIG. 3*a*, and positioned by engaging the pilot punches 21 with pilot holes 30*a* formed in the strip 30. Assuming that the strip 30 is fed to the position shown in FIG. 3*a*, the striking punch 22 and the blank-through punch 23 strike the strip 30. The striking punch 22 bends the strip 30 into a concave spherical shape by the spherical working surface 22*a* and the concave spherical recess 22*b* to form a concave portion 30*b*. The blank-through punch 23 blanks the strip 30 along a periphery of the concave portion 30*b* formed by the striking punch 22 with the blanking hole 23*a*. Thus, a concave plate 30*c* as the armature 8 is produced having a uniform thickness. The concave plate 30*c* is push-backed to the strip 30 and fed to a next step together with the strip 30, where the vibrating plate 7 is fixed by a spot welding (pinpoint welding).

Figure 4A:
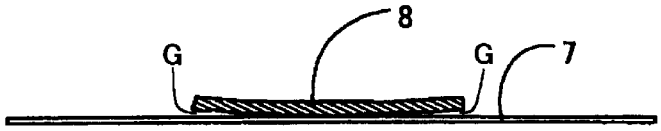
FIGS. 4*a* and 4*b* show sectional views showing vibrating states of a vibrating plate of the present invention.

FIG. 4*a* shows a sectional view of the armature 8. Since the armature 8 is bent into a spherical shape at a radius of curvature, a gap G is formed between the peripheral edge of the armature and the vibrating plate 7.

Figure 4B:
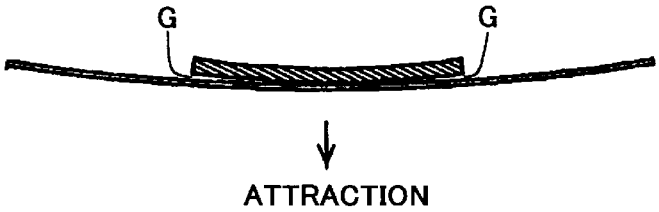
Figure 5:
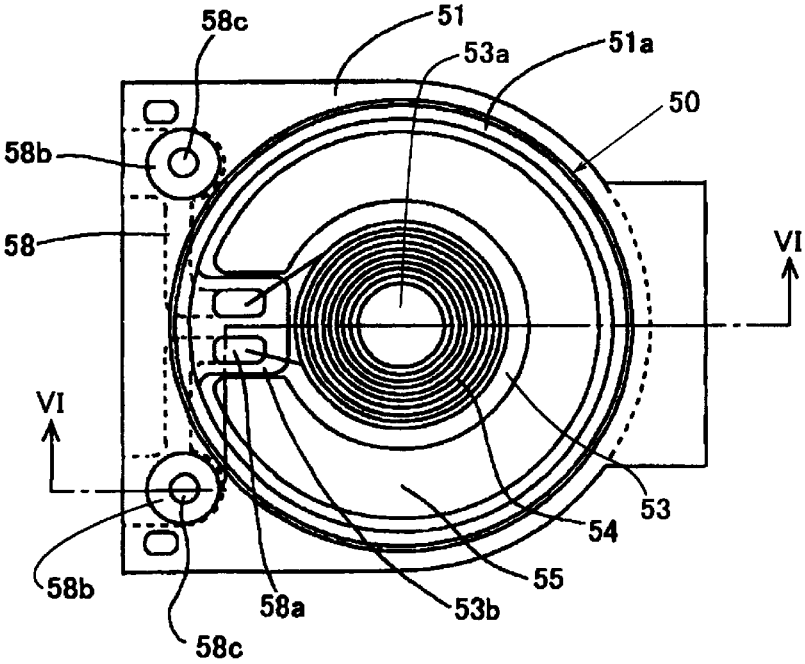
FIG. 5 PRIOR ART
FIG. 5 is a plan view of a conventional electromagnetic sound generator in which upper parts thereof are removed along a line V—V of FIG. 6.
Figure 6:
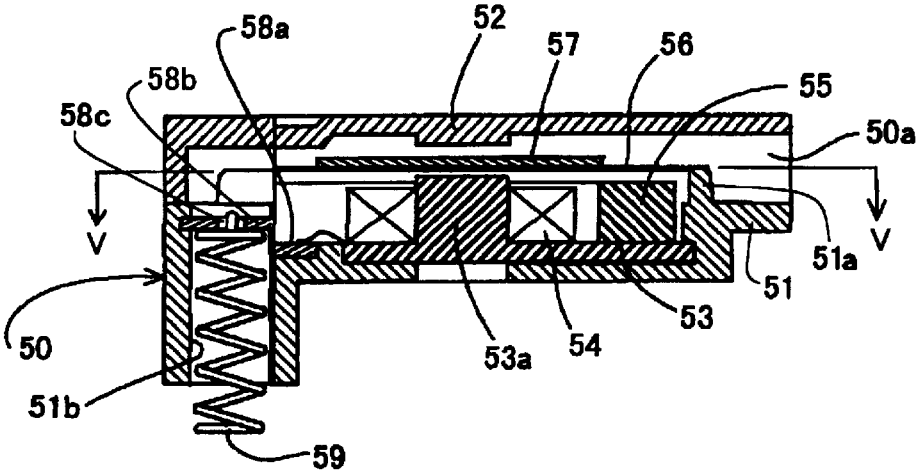
FIG. 6 PRIOR ART
FIG. 6 is a sectional view taken along a line VI—VI of FIG. 5.
Figure 7A:
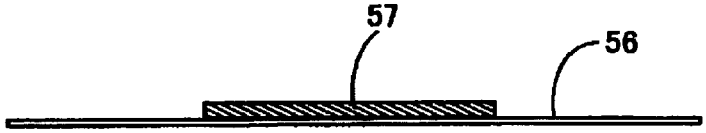
FIG. 7a PRIOR ART
FIGS. 7*a* and 7*b* are sectional views of a vibrating plate of the sound generator.
Figure 7B:
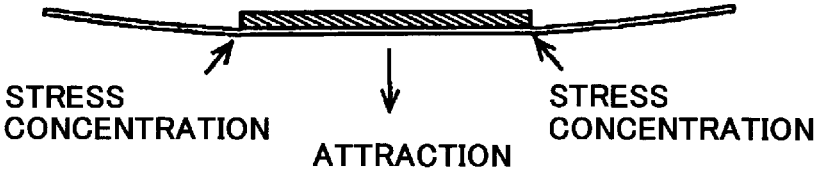
FIG. 7b PRIOR ART

When the coil 6 is energized, the armature 8 is attracted to the core 4*a*. As shown in FIG. 4*b*, even if the armature vibrates at a maximum amplitude, there remains a gap G. The radius of curvature is therefore selected so that the peripheral edge of the armature does contact with the vibrating plate 7 when the armature 8 vibrates at a maximum amplitude. Thus, stress concentration does not generate along the peripheral edge of the armature 8. Therefore, the vibration of the vibrating plate 7 is not restrained.

In accordance with the present invention, since the vibration of the vibrating plate is not restrained by the stress concentration, the vibrating plate stably vibrates.

While the invention has been described in conjunction with preferred specific embodiment thereof, it will be understood that this description is intended to illustrate and not limit the scope of the invention, which is defined by the following claims.

What is claimed is:

1. An electromagnetic sound generator comprising:

a case;

an electromagnet having a vibrating plate mounted in the case;

an armature comprising a circular magnetic plate and secured to the vibrating plate, wherein the armature has a concave spherical shape, and is secured to the vibrating plate at a central portion of an underside thereof so as to form a gap between a peripheral edge of the armature and the vibrating plate.

2. The electromagnetic sound generator according to claim 1 wherein the armature has a uniform thickness.

3. The electromagnetic sound generator according to claim 1 wherein the armature has a radius curvature so that a peripheral edge of the armature does not contact with the vibrating plate when the vibrating plate is vibrated at a maximum amplitude.

* * * * *